US006642649B1

(12) United States Patent
Yamamoto et al.

(10) Patent No.: US 6,642,649 B1
(45) Date of Patent: Nov. 4, 2003

(54) ELECTRON-EMITTING DEVICE, ELECTRON SOURCE USING THE ELECTRON-EMITTING DEVICE, AND IMAGE-FORMING APPARATUS USING THE ELECTRON SOURCE

(75) Inventors: Keisuke Yamamoto, Yamato; Tamaki Kobayashi, Isehara; Satoshi Mogi, Kawasaki, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/513,133

(22) Filed: Feb. 25, 2000

(30) Foreign Application Priority Data

Feb. 26, 1999 (JP) ..... 11-051951
Feb. 15, 2000 (JP) ..... 2000-041454

(51) Int. Cl.[7] ..... H01J 1/62
(52) U.S. Cl. ..... 313/495; 313/336; 313/310
(58) Field of Search ..... 313/495, 496, 313/497, 320, 336, 351, 238, 292, 243, 240, 250, 609, 610, 621

(56) References Cited

U.S. PATENT DOCUMENTS

| | | | | |
|---|---|---|---|---|
| 5,470,265 | A | 11/1995 | Nomura et al. | 445/24 |
| 5,530,314 | A * | 6/1996 | Banno et al. | 313/310 |
| 5,578,897 | A | 11/1996 | Nomura et al. | 313/310 |
| 5,986,389 | A | 11/1999 | Tsukamoto | 313/310 |
| 6,169,356 | B1 | 1/2001 | Ohnishi et al. | 313/495 |
| 6,208,071 | B1 * | 3/2001 | Nishimura et al. | 313/495 |

FOREIGN PATENT DOCUMENTS

| | | |
|---|---|---|
| EP | 0 660 357 | 6/1995 |
| JP | 7-235255 | 9/1995 |
| JP | 07-235255 | 9/1995 |
| JP | 08-273523 | 10/1996 |
| JP | 2854385 | 11/1998 |
| JP | 2903295 | 3/1999 |
| JP | 2000-285789 | 10/2000 |
| JP | 2001-148222 | 5/2001 |

OTHER PUBLICATIONS

M.I. Elinson et al., "The Emission of Hot Electrons and The Field Emission of Electrons From Tin Oxide", Radio Engineering and Electronic Physics, Jul. 1965, pp. 1290–1296.
H. Araki, "Electroforming and Electron Emission of Carbon Thin Films", Journal of the Vacuum, Society of Japan, 1983, pp. 22–29 (with English Abstract on p. 22).
G. Dittmer, "Electrical Conduction and Electron Emission of Discontinuous Thin Films", Thin Solid Films, 9, 1972, pp. 317–328.
M. Hartwell, "Strong Electron Emission From Patterned Tin–Indium Oxide Thin Films", IEDM, 1975, pp. 519–521.

* cited by examiner

*Primary Examiner*—Sandra O'Shea
*Assistant Examiner*—Bao Truong
(74) *Attorney, Agent, or Firm*—Fitzpatrick, Cella, Harper & Scinto

(57) ABSTRACT

There are here disclosed an electron-emitting device, comprising a pair of conductors arranged on a substrate so as to face each other, and a pair of deposited films containing carbon as a main component which are connected to the pair of conductors respectively and which ate arranged putting a gap therebetween, wherein silver is contained in a ratio of 5 mol % to 10 mol % with respect to carbon in the deposited film, an electron source comprising the plurality of electron-emitting devices arranged on a substrate and a wire connected to the electron-emitting devices and an image-forming apparatus comprising the electron source and an image-forming member which performs image formation by the collision of electrons emitted from the electron source.

14 Claims, 9 Drawing Sheets

ELECTRON-EMITTING DEVICE, ELECTRON SOURCE USING THE ELECTRON-EMITTING DEVICE, AND IMAGE-FORMING APPARATUS USING THE ELECTRON SOURCE

BACKGROUND OF THE INVENTION

1. Field of the Invention

The present invention relates to an electron-emitting device, an electron source comprising this electron-emitting device, and an image-forming apparatus such as a display to which the electron source is applied. More especially, it relates to a surface conduction electron-emitting device having a novel constitution, an electron source using this surface conduction electron-emitting device, and an image-forming apparatus such as a display to which the electron source is applied.

2. Related Background Art

A surface conduction electron-emitting device utilizes a phenomenon in which electron emission occurs by applying a current to an electroconductive film formed on a substrate.

As examples of this surface conduction electron-emitting device, there have been reported a device using an $SnO_2$ thin film [M. I. Elinson, Radio Eng. Electron Phys., 10, 1290, (1965)], a device using an Au thin film [G. Ditmmer, Thin Solid Films, 9, 317 (1972)], a device using an $In_2O_3/SnO_2$ thin film [M. Hartwell and C. G. Fonsted, IEEE Trans. ED Conf., 519 (1975)], and a device using a carbon thin film [Hisahi Araki et al., Sinku (Vacuum), Vol. 26, No. 1, 22 p., (1983)].

In these surface conduction electron-emitting devices, generally speaking, the state is set in which electron emission occurs by performing energization forming operation called "forming" to the above electroconductive film before performing the electron emission.

Here, "forming" indicates that the state is set in which electron emission occurs by applying a constant voltage or for example, a voltage which slowly rises at a rate of about 1 V per minute to both the ends of the above electroconductive film, applying a current to the above electroconductive film, locally damaging, deforming or deteriorating the above electroconductive film and making it enter an electrically high resistive state.

It is considered that a fissure is formed on a part of the above electroconductive film by this operation and the phenomenon of electron emission results from the existence of this fissure. Besides, it is not made clear completely that the actual electron emission occurs in which part, but the above fissure and its peripheral area may be called a "electron-emitting region" for convenience.

This applicant has already advanced many proposals on a surface conduction electron-emitting device. For example, that it is desirable the above "forming" should be performed by applying a pulse voltage to an electroconductive film is disclosed in Japanese Patent No. 2,854,385, U.S. Pat. Nos. 5,470,265 and 5,578,897.

Here, for a pulse voltage waveform, both the method of maintaining a peak value constant, as shown in FIG. 5A, and the method of slowly increasing the peak value, as shown in FIG. 5B, are acceptable and can properly be selected considering the shape and material of a device and its forming conditions.

Further, immediately followed by the above forming, it is detected that both a current (device current If) applied to a device and a current (emission current Ie) caused by electron emission is increased by repeatedly applying a pulse voltage to an electron-emitting device under the atmosphere containing organic substances, and this operation is called "activation".

This operation forms a deposited film whose main component is carbon in the area containing the fissure formed on an electroconductive film by "forming", and the details are disclosed in Japanese Patent Application Laid-Open No. 7-235255.

To adapt such surface conduction electron-emitting apparatus as described above to an image-forming apparatus, its low power consumption and high luminance are still more requested.

Consequently, it is requested as the performance of an electron-emitting device that the ratio of the emission current Ie to the device current If, i.e. the electron emission efficiency should be increased more than before.

SUMMARY OF THE INVENTION

An object of the present invention is to provide an electron-emitting device which is excellent in electron emission characteristics, an electron source which uses the electron-emitting device and an image-forming apparatus which uses the electron source.

The present invention is an electron-emitting device comprising a pair of conductors arranged on a substrate so as to face each other and a pair of deposited films whose main component is carbon which are arranged by being connected to a pair of these conductors and arranged by being caught in a gap, wherein silver is contained in the deposited film at a ratio of carbon within the range of 5 mol % or more and less than 10 mol %.

Further, the present invention is an electron-emitting device comprising a pair of device electrodes arranged on a substrate so as to face each other, an electroconductive film which is arranged by being connected to a pair of these device electrodes and has a fissure between a pair of the device electrodes and a deposited film whose main component is carbon which is formed on the area containing the inside of the fissure and the fissure and has a gap having a narrower width the fissure in the fissure, wherein silver is contained in the deposited film at a ratio of carbon within the range of 5 mol % or more and less than 10 mol %.

DETAILED DESCRIPTION OF THE PREFERRED EMBODIMENTS

Figure 1A:
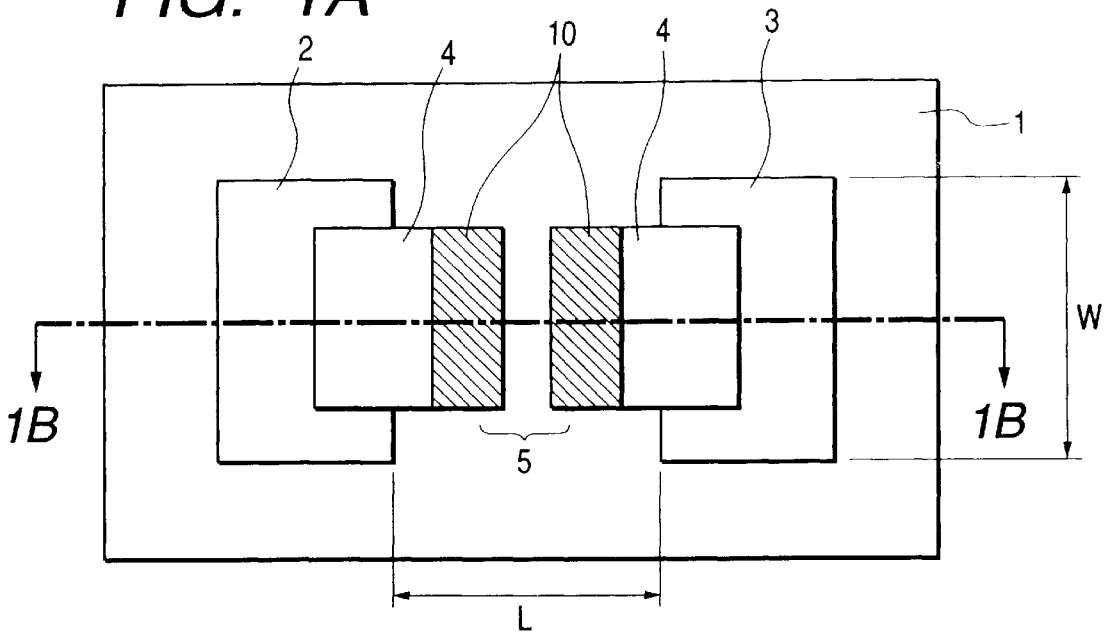
FIGS. 1A and 1B are type diagrams showing the rough configuration of an electron-emitting device according to the embodiment of the present invention.

The present invention is an electron-emitting device comprising a pair of conductors arranged on a substrate so as to face each other and a pair of deposited films whose main component is carbon which are arranged by being connected to a pair of these conductors respectively and arranged and arranged by being caught in a gap, wherein silver is contained in the deposited film at a ratio of carbon within the range of 5 mol % or more and less than 10 mol %.

Further, the present invention is an electron-emitting device comprising a pair of device electrodes arranged on a substrate so as to face each other, an electroconductive film having a fissure between a pair of the device electrodes and a deposited film whose main component is carbon which is formed on the area containing the inside of the fissure and the fissure and has a gap having a narrower width than the fissure in the fissure, wherein silver is contained in the deposited film at a ratio of carbon within the range of 5 mol % or more and less than 10 mol %.

An electron source of the present invention comprises a plurality of the electron-emitting devices arranged on a substrate and the wiring connected to these electron-emitting devices.

Furthermore, an image-forming apparatus of the present invention comprises the electron source and an image-forming member which performs image formation by making electrons emitted from the electron source collide with one after another.

[Embodiments]

Referring to the drawings, an embodiment suitable to this invention is illustratively described below in detail. However, it is to be understood that the dimensions, materials and shapes of a component, and its relative configuration described in this embodiment, the scope of this invention is not simply for the purpose of limitation unless otherwise specified.

Figure 1B:
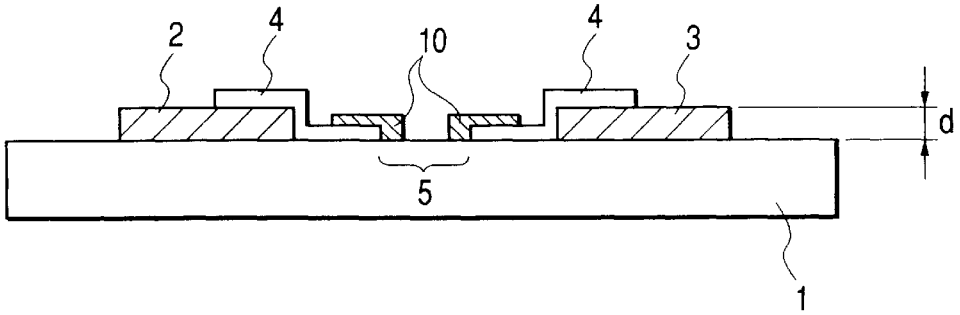

First, referring to FIGS. 1A and 1B, the basic configuration of an electron-emitting device according to the embodiment is described. FIGS. 1A and 1B are type diagrams showing the rough configuration of the electron-emitting device according to the embodiment of the present invention. FIG. 1A is a type diagram of the electron-emitting device viewed from a plane and FIG. 1B is a type diagram of the electron-emitting device viewed from a cross section (cross section which runs in parallel to the line 1B—1B of FIG. 1A).

In FIGS. 1A and 1B, 1 is a substrate as a base substance made of insulating materials. On this substrate 1, a pair of device electrodes 2 and 3 arranged so as to face each other are provided and an electroconductive film 4 connected to a pair of these device electrodes 2 and 3 is provided.

Besides, the example shown in the diagram shows the case where a conductor is comprised of the device electrodes 2 and 3 and the electroconductive film 4 as described above. Even if the conductor is comprised of only the device electrodes 2 and 3 by omitting the electroconductive film 4, the equivalent function can be shown as an electron-emitting device.

Further, in the diagram, 5 typically shows a fissure formed on the electroconductive film 4 and this fissure 5 is provided between a pair of the device electrodes 2 and 3.

Furthermore, in the diagram, 10 is a deposited film whose main component is carbon. Here, the deposited film 10 shown in the diagram is formed on only the electroconductive film 4. According to a formation method, it is also formed on the device electrodes 2 and 3. Moreover, it may be also formed on the substrate 1 other than the inside of the fissure 5.

The deposited film 10 whose main component is this carbon is also formed in the fissure 5 as well as around the fissure 5. It is formed in this fissure 5 so as to have a narrower gap than this fissure 5.

Figure 2:
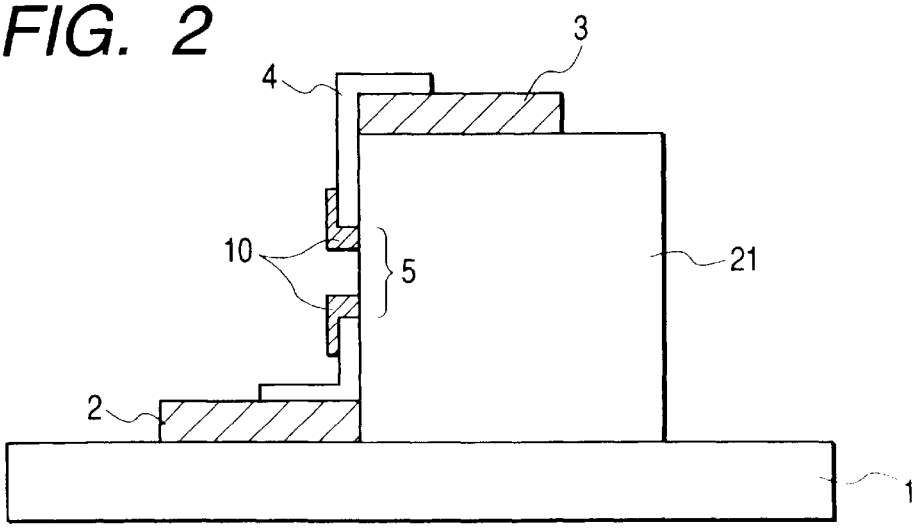
FIG. 2 is a typical cross section of the electron-emitting device according to the embodiment of the present invention.

Besides, as another basic configuration of an electron-emitting device, there is also a perpendicular configuration shown in FIG. 2. FIG. 2 is a typical cross section of the electron-emitting device according to the embodiment of the present invention.

In the diagram, 21 is a step-forming member made of insulating materials and is provided on the substrate 1 to form a step. Another basic configuration is the same as shown in FIGS. 1A and 1B shown above and the same symbol as FIGS. 1A and 1B is affixed to it.

Here, as the properties requested for the above device electrodes 2 and 3, sufficient conductivity is needed, and as their materials, metals, alloys or conductive metal oxides and printed conductors made of mixtures such as the above materials and glass and semiconductors.

To desirably perform the formation of a fissure by forming, that is, to desirably perform the allocation of electron emission capacity, it is desirable that the above electroconductive film 4 is composed of fine particles of electroconductive materials. For example, electroconductive materials such as Ni, Au, PdO, Pd and Pt can be used as the materials.

Particularly, PdO is an ideal material because it has such advantages that an electroconductive film made of fine particles can easily be formed by forming an organic Pd compound film and then baking it under an atmosphere, and it is comparatively lower in electrical conductivity than metal owing to a semiconductor, and it is easy to control so as to obtain a value of resistance suitable for forming and it can be reduced comparatively easily, thereby being able to reduce resistance by obtaining the metal Pd after a fissure has been formed by forming.

The formation of the deposited film 10 whose main component is the above carbon can be performed by the method of "activation" described previously.

Then, the control of an amount of silver (hereinafter referred to as Ag) contained in the deposited film 10 whose main component is this carbon can adopt the method of further introducing the raw-material gas containing Ag under the atmosphere containing organic materials and controlling the amount when performing activation or the method of first forming a deposited film, then coating it with a liquid which contains Ag in the form of organometal compounds, subsequently heat-treating it to contain Ag and controlling the coating amount of the above liquid.

According to the examination made by this inventor, it is made clear that the effect that electron emission efficiency is improved when Ag contains 5 mol % or more at a ratio of carbon.

On the other hand, it is made clear that as the Ag content increases excessively, an amount of electron emission is reduced conversely. This inventor finds out that it is acceptable the Ag content should be less than 10 mol % against carbon regarding this point, too, and produces the present invention.

Although such reason is not sufficiently identified, it is presumed that this is because Ag is educed in a deposited film whose main component is carbon, thereby lowering the electrical resistance of the deposited film and effectively raising the voltage applied to the gap of the deposited film. Further, it is presumed that the reason the electron emission efficient lowers conversely as the Ag content increases is because the work function of the surface increases effectively as Ag is exposed on the surface of the deposited film.

Next, a more specific example configured based on the embodiment of the above invention is described.

EXAMPLE

Example of Electron-Emitting Device

An electron-emitting device according to this example has the same configuration as shown in FIGS. 1A and 1B described previously.

Based on FIGS. 1A and 1B, and FIGS. 3A to 3D, the manufacturing method of the electron-emitting device according to this example is described.

(Process-a)

First, a photoresist pattern is formed on a cleaned quartz substrate 1 so as to have an opening which corresponds to the shapes of device electrodes 2 and 3, and Ti of 5 nm thick and Pt of 30 nm thick are sequentially deposited on it by the vacuum deposition method.

Then, the photoresist pattern is dissolved and removed by an organic solvent and an electrode made of a Pt/Ti lamination film is formed by the lift-off technique. Where, electrode clearance L shall be 50 $\mu$m and electrode width W shall be 300 $\mu$m (see FIG. 3A).

(Process-b)

A Cr film is formed in 100 nm thick by the vacuum deposition method and subsequently the Cr film is patterned by the photolithography technique so as to have the opening which corresponds to the shape of an electroconductive film described later. Then, after the Cr film has been coated with the liquid of an organic Pd compound (ccp4230 made by Okuno Pharmaceutical Co., Ltd.) using a spinner and dried, heat treatment of 350 degrees C. is performed under an atmosphere for 12 minutes.

An electroconductive film of 10 nm thick made of PdO fine particles is formed by this treatment. The sheet resistance Rs of this film is $2\times10^4$ Ω/□.

Besides, the sheet resistance Rs is a quantity expressed as R=(1/w) Rs assuming the value of resistance in which a film of 1 long and w wide is measured by applying a current to the lengthwise direction is R. If the film is uniform, the sheet resistance is expressed as Rs=ρ/t assuming resistivity is ρ and coating thickness is t.

(Process-c)

Figure 3A:
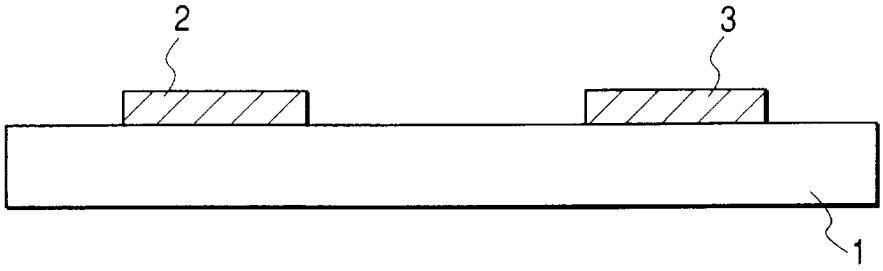
FIGS. 3A, 3B, 3C and 3D are illustrations of the manufacturing process of an electron-emitting device according to the example of the present invention.
Figure 3B:
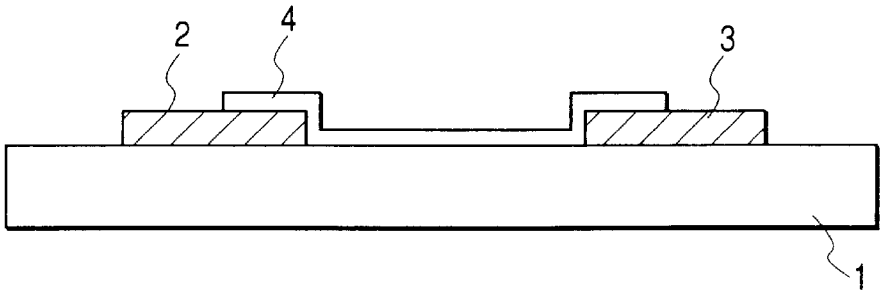

The above Cr film is removed using a Cr etchant and an electroconductive film is patterned into a desired shape by the lift-off technique (see FIG. 3B).

(Process-d)

Figure 3C:
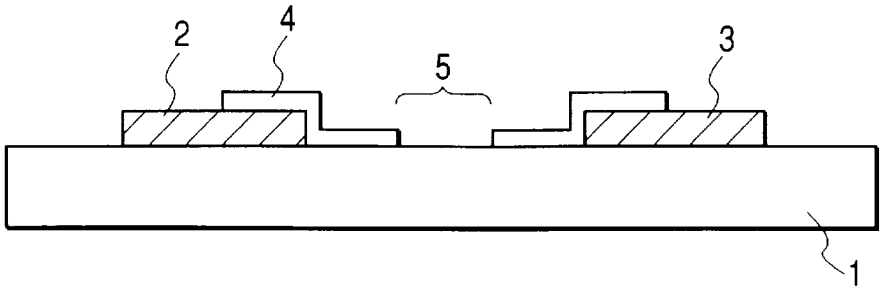
Figure 3D:
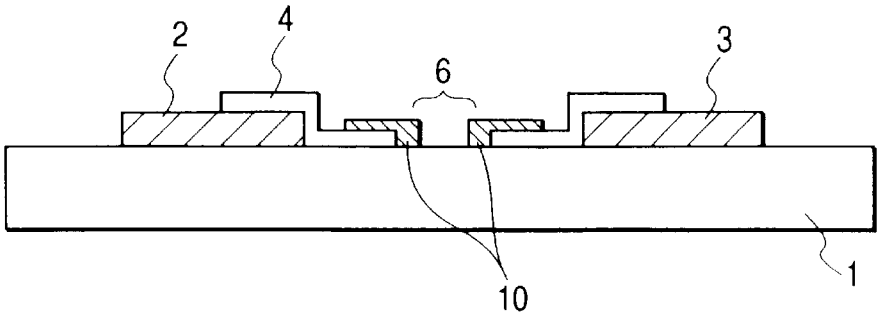

After the above device has been installed under a vacuum treating device and the pressure of a vacuum chamber is decreased by an exhaust device to $2.7\times10^{-4}$ Pa, a fissure 5 is formed on a part of an electroconductive film by applying a pulse voltage between the electrodes 2 and 3 and performing forming operation (see FIG. 3C).

Figure 5A:
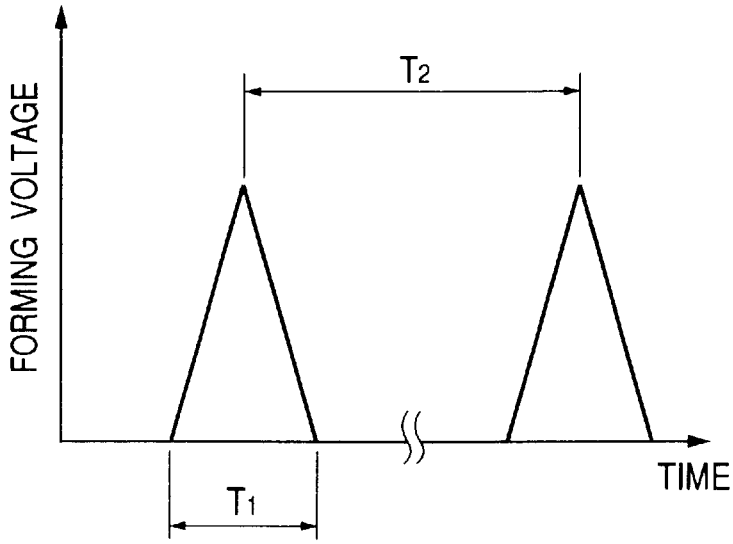
FIGS. 5A and 5B are pulse voltage waveform diagrams used in the forming process when an electron-emitting device is produced according to the example of the present invention.
Figure 5B:
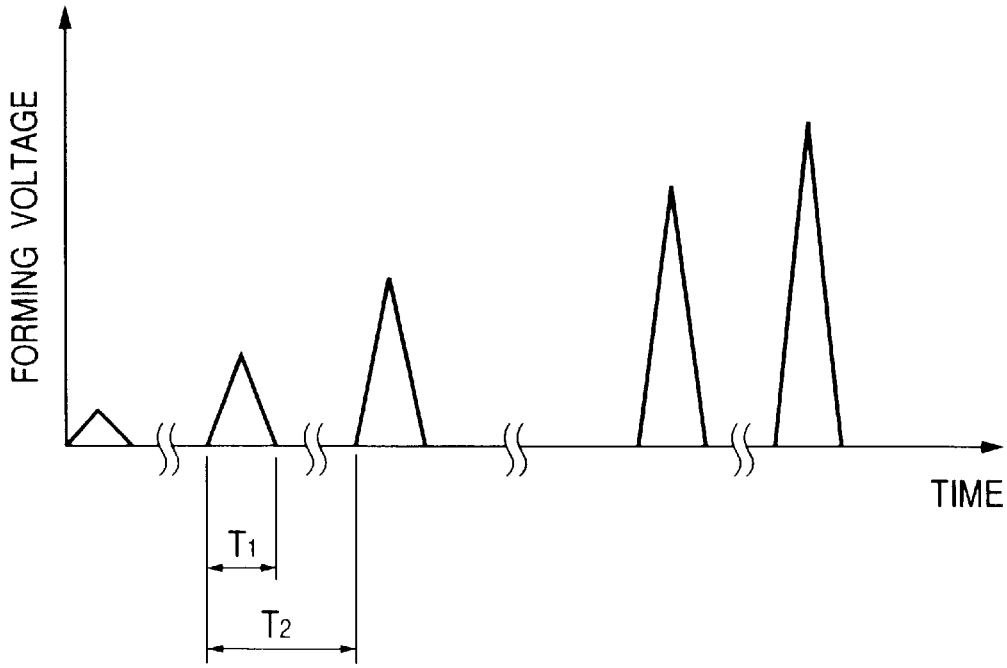

The waveform of the above pulse voltage used in forming is shown in FIG. 5B. The forming operation is performed by setting a pulse width T1 to 1 msec. and a pulse interval T2 to 10 msec. and slowing raising a peak value in 0.1 V steps.

Besides, during this forming operation, a value of resistance of a device is obtained by inserting a rectangular wave pulse of a peak value of 0.1 V between the above pulses and measuring a current value. When such obtained value of resistance exceeds 1 MΩ, impression of the pulse is stopped and forming is completed.

(Process-e)

Subsequently, the process of activation is performed. After the exhaust of a vacuum chamber has been continued and the pressure of the chamber has decreased to $1.3\times10^{-6}$ Pa, benzonitrile is introduced into the chamber via a slow leak valve mounted on the vacuum chamber. The slow leak valve is adjusted so that the pressure of benzonitrile can be $1.3\times10^{-4}$ Pa.

Figure 10:
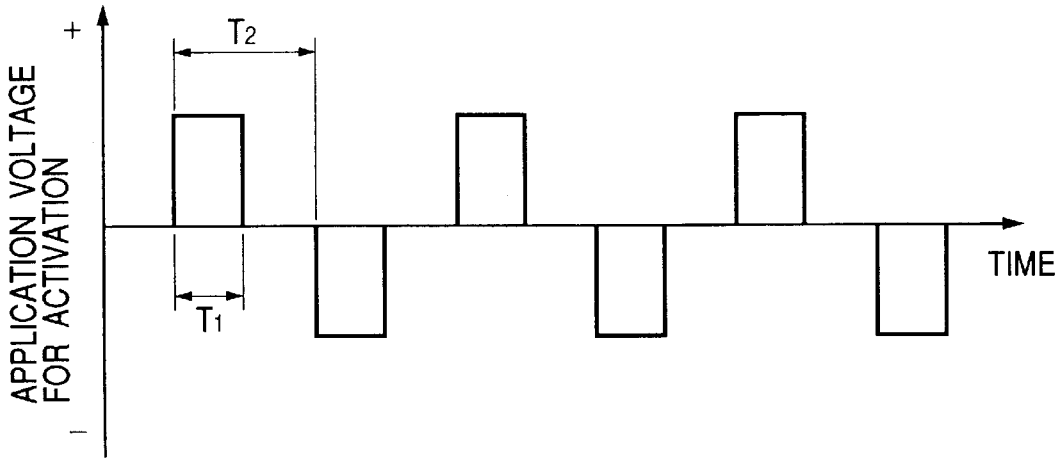
FIG. 10 is a pulse voltage waveform diagram used in the activation process when an electron-emitting device is produced according to the example of the present invention.

Then, a pulse voltage is applied between the device electrodes 2 and 3. The waveform of the applied pulse is a rectangular pulse whose polarity is reversed every pulse, as shown in FIG. 10. The pulse impression is performed for 60 minutes by setting the pulse width T1 to 1 msec., the pulse interval T2 to 100 msec., and a pulse peak value to 15 V. (The time of pulse impression is the time obtained by a preliminary investigation assuming that the increase of a device current If is saturated under this operation condition.)

A deposited film 10 whose main component is carbon is formed in the area containing the fissure 5 formed on an electroconductive film by this operation is formed. The deposited film 10 whose main component is the carbon is deposited so as to form a narrower gap 6 than the fissure 5 in the fissure 5 (see FIG. 3D).

(Process-f)

Next, a device is taken out outside a vacuum chamber and is coated with an ammonium dicyanoargentate (I) aqueous solution. The heat treatment of 200 degrees C. is applied to it under vacuum and Ag is contained in a deposited film whose main component is carbon. The adjustment of the Ag content is performed by previously obtaining the relationship between the coating amount of the ammonium dicyanoargentate (I) aqueous solution and the content and adjusting the coating amount.

Samples in which amounts of Ag for carbon are 5 mol % (example 1), 7.5 mol % (example 2), 10 mol % (example 3) and 12.5 mol % (comparative example 2) are produced. Further, for comparison, an example (comparative example 1) in which the addition of Ag is not performed is also prepared.

At this time, the measurement of Ag content against carbon is performed by the photoelectron spectrometry. The device used is ESCA LAB 22OI-XL made by VG Scientific Co., Ltd. For the measurement, the ratio of Ag to C is obtained from the 3d Peak of Ag and 1s peak of C (carbon) observed from the area of one side of 50 $\mu$m centered around the above fissure portion is obtained. Besides, the measurement limit of Ag under this condition is about 0.1 mol %.

(Process-g)

A device is rearranged under a vacuum device and the inside of the vacuum chamber is evacuated. The vacuum chamber and the device are held at 200 degrees C. for ten hours. This treatment removes the molecules of water and organic substances adsorbed in the device and the vacuum chamber, and is called "stabilization operation".

Figure 4:
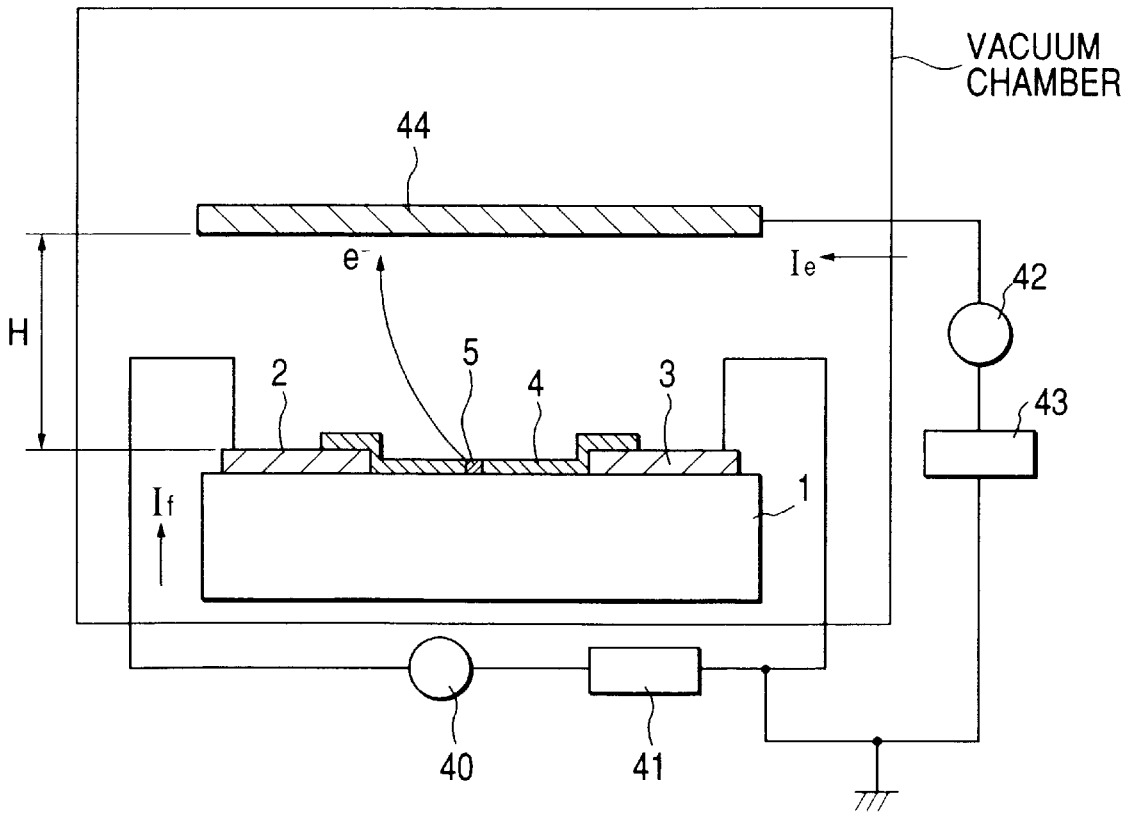
FIG. 4 is a block diagram showing an outline of the evaluation device of an electron-emitting device according to the example of the present invention.

Regarding the above device, an electronic emission characteristic and its deterioration with age are measured using the device whose outline is shown in FIG. 4.

That is, a rectangular pulse of a pulse width of 1 msec., a pulse interval of 100 msec., and a peak value of 15 V is applied to a device by a pulse generator 41. Besides, the clearance H between the device and an anode electrode 44 shall be set to 4 mm. A constant voltage of 1 kV is applied to the anode electrode 44 by a high-voltage power supply 43. At this time, the device electrode If and the emission current Ie are measured by an ammeter 40 and an ammeter 42 respectively and the electron emission efficient $\eta$=(Ie/If) is obtained.

This result is shown below.

TABLE 1

| | Comparative Example 1 | Example 1 | Example 2 | Example 3 | Comparative Example 2 |
|---|---|---|---|---|---|
| Ag/C (mol %) | 0 | 5.0 | 7.5 | 10.0 | 12.5 |
| $\eta$ (%) | 0.12 | 0.15 | 0.16 | 0.16 | 0.10 |

As a result, it is made clear that the rise of electron emission efficient occurs because Ag is contained 5 to 10 mol % in a deposited film whose main component is carbon.

Example of Electron Source and Image-Forming Apparatus

An electron source can be formed by arranging a plurality of electron-emitting devices according to the embodiment or example of the present invention described above on a substrate and further forming the wiring connected to these devices.

Figure 6:
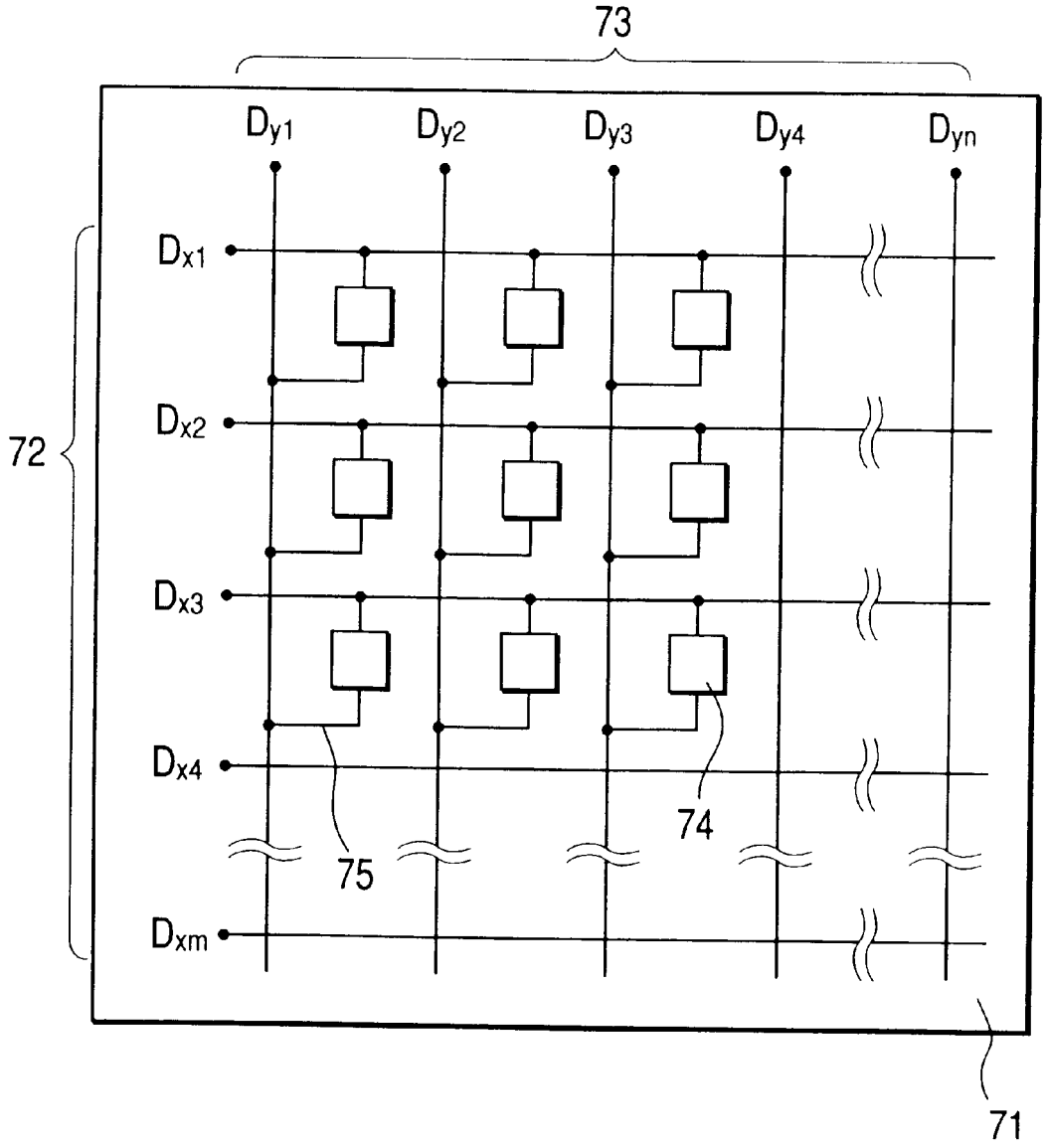
FIG. 6 is a type diagram of an electron source according to the example of the present invention.

One example of the configuration is shown in FIG. 6. 71 is a substrate 72 are m pieces of X-directional wiring Dx1 to Dxm, 73 are n pieces of Y-directional wiring Dy1 to Dyn, 74 are electron-emission devices according to the embodiment or example of the present invention and 75 is a connection which connects the above wiring and device. Further, an insulating layer not shown is arranged at the intersection portion between the X-directional wiring and the Y-directional wiring so that both can electrically be insulated.

Moreover, an image-forming apparatus can be comprised of the above electron source and an image-forming member which forms an image by the irradiation of an electron emitted from the electron source.

Figure 7:
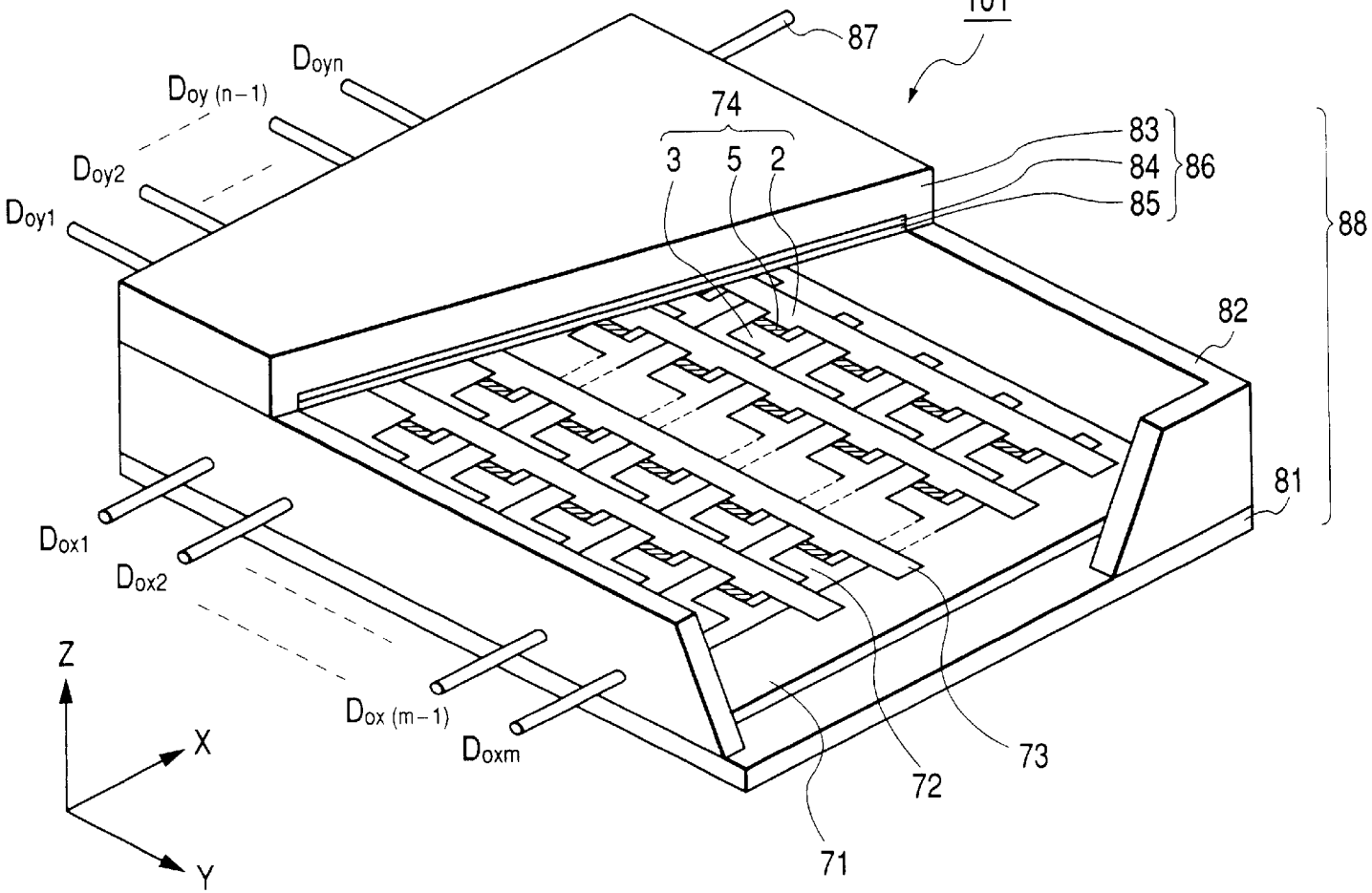
FIG. 7 is a typical, partial cutaway perspective diagram of the image-forming apparatus which uses the electron source shown in FIG. 6.

One example of the configuration is shown in FIG. 7. In the diagram, 81 is a rear plate, 82 is a supporting frame, 83 is a glass substrate, 86 is a face plate and these comprise an envelope 88. The electron source described previously is arranged inside the envelope 88 and this envelope holds the inside airtight.

Dox1 to Doxm and Doy1 to Doyn indicate external terminals connected to the X-directional wiring Dx1 to Dxm and the Y-directional wiring Dy1 to Dyn. 84 is an image-forming member made of phosphors and 85 is a metal-backed phosphor screen made of metal deposition films. The latter reflects the light emitted from the image-forming member 84 toward the inside of the envelope 88 to the outside and improves luminance, and functions as an anode electrode for accelerating the electron emitted from an electron source.

87 is a high-voltage terminal connected to this metal-backed phosphor screen 85 and is connected to a power supply for applying a high voltage to the metal-backed phosphor screen (anode electrode) 85.

Besides, in the example shown in the diagram, the rear plate 81 and the substrate 71 of the electron source are provided separately. If the substrate 71 has sufficient strength, it can also be served both as the rear plate.

Figure 8:
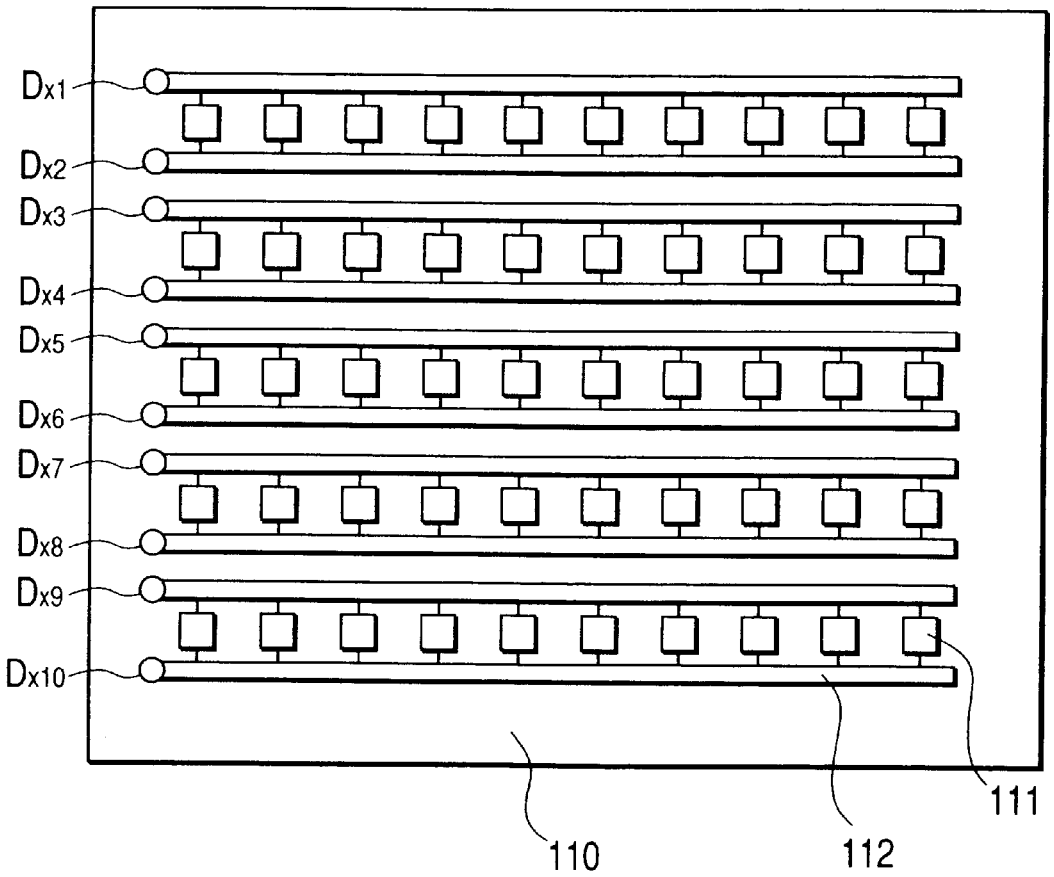
FIG. 8 is a type diagram showing another configuration of an electron source according to the example of the present invention.

As the configuration of an electron source, such configuration as shown in FIG. 8 can also be adopted. That is, a plurality of wiring 112 are formed in parallel on a substrate 110, a plurality of electron emission devices 111 are arranged between a pair of wiring and a plurality of device lines are formed.

Figure 9:
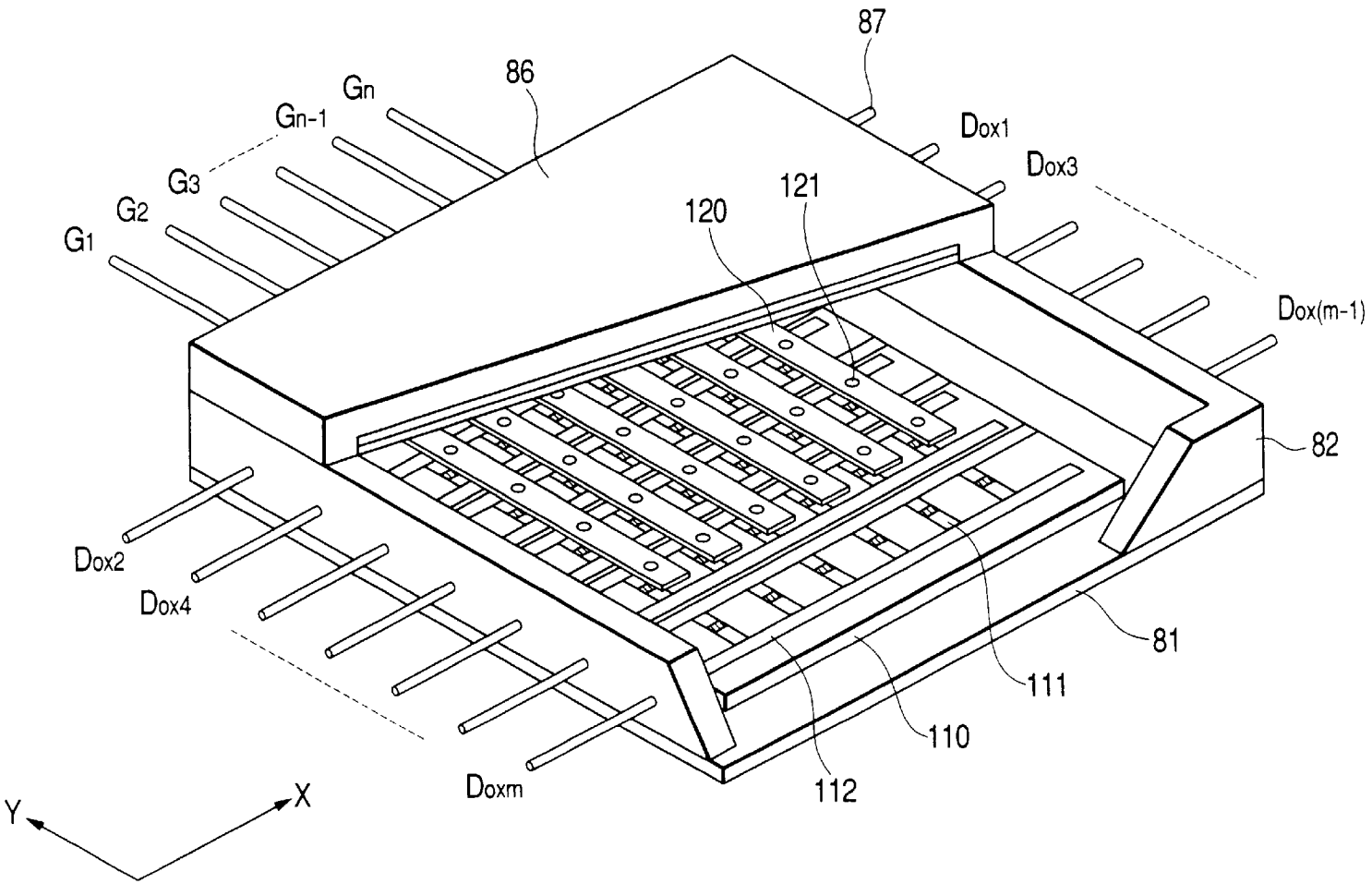
FIG. 9 is a typical, partial cutaway perspective diagram of the image-forming apparatus which uses the electron source shown in FIG. 6.

One example of the configuration of an image-forming apparatus which uses an electron source having such configuration is shown in FIG. 9. In such configuration, a plurality of grid electrodes 120 which extend in the direction orthogonal to the direction of the device line of the above electron source, and have the function of modulating the electron beam emitted from an electron-emitting device which is assigned to the one line selected by a driver among the above device lines.

Each grid electrode has an electron through hole 121 for passing through an electron at the position which corresponds to an electron-emitting device.

Dox1 to Doxm indicate external terminals connected to the above wiring. The diagram shows the case where odd-numbered wiring and even-numbered wiring are taken out externally from the side of a supporting frame on the reverse side. G1 to Gn indicate grid external terminals connected to the above grid electrodes.

As described above, the present invention can improve electron emission efficient by containing silver in a deposited film whose main component is carbon at a ratio of carbon within the range of 5 mol % or more and less than 10 mol %.

What is claimed is:

1. An electron-emitting device, comprising a pair of conductors arranged on a substrate so as to face each other, and a pair of deposited films containing carbon as a main component which are connected to the pair of conductors respectively and which are arranged putting a gap therebetween, wherein silver is contained in a ratio of 5 mol % to 10 mol % with respect to carbon in the deposited film.

2. An electron-emitting device, comprising a pair of device electrodes arranged on a substrate so as to face each other, an electroconductive film connected to the pair of device electrodes and having a fissure between the pair of device electrodes, and a deposit containing carbon as a main component which is formed on an area including the inside of the fissure and the fissure and which has a gap having a narrower width than the fissure in the fissure, wherein silver is contained in a ratio of 5 mol % to 10 mol % with respect to carbon in the deposited film.

3. An electron source, comprising a plurality of electron-emitting devices described in claim 1 or 2 arranged on a substrate and a wire connected to these electron-emitting devices.

4. An image-forming apparatus, comprising the electron source described in claim 3, and an image-forming member which performs image formation by the collision of electrons emitted from the electron source.

5. An electron-emitting device comprising:

a carbon film composed chiefly of carbon; and an electrode electrically connected to the carbon film, wherein silver is contained in the carbon film in a ratio of 10 mol % or less with respect to carbon.

6. An electron-emitting device comprising:

a carbon film composed chiefly of carbon; and an electrode electrically connected to the carbon film, wherein silver is contained in the carbon film in a ratio of from 5 mol % to 10 mol % with respect to carbon.

7. An electron-emitting device comprising:

a pair of electroconductors disposed on a substrate; and a pair of films connected to the pair of electroconductors, respectively, disposed with a gap therebetween and containing carbon as a main component, wherein silver is contained in said films in a ratio of 10 mol % or less with respect to carbon.

8. An electron-emitting device comprising:

a pair of device electrodes disposed on a substrate;

an electroconductive film connected to the pair of device electrodes and having a first gap between the pair of device electrodes; and a carbon film disposed in the first gap and on the electroconductive film, and having a second gap narrower in width than that of the first gap, within the first gap, and containing carbon as a main component, wherein silver is contained in the carbon film in a ratio of 10 mol % or less with respect to carbon.

9. An electron-emitting device comprising:

a pair of device electrodes disposed on a substrate so as to face each other;

an electroconductive film connected to the pair of device electrodes and having a first gap between the pair of device electrodes; and a carbon film disposed in the first gap on the electroconductive film, and having a second gap narrower in width than that of the first gap, within the first gap, and containing carbon as a main component, wherein silver is contained in the carbon film in a ratio of from 5 mol % to 10 mol % with respect to carbon.

10. An electron source comprising a plurality of electron-emitting devices disposed on a substrate, and wirings connected to said electron-emitting devices, wherein each electron-emitting device is an electron-emitting device according to any on of claims 5 to 9.

11. An image-forming apparatus comprising an electron source according to claim 10, and an image forming member.

12. An electron-emitting device comprising:

a carbon film composed chiefly of carbon; and an electrode electrically connected to the carbon film, wherein silver is contained in the carbon film in a ratio of 5 mol % or more with respect to carbon.

13. An electron source comprising a plurality of electron-emitting devices disposed on a substrate, and wirings connected to said electron-emitting devices, wherein each electron-emitting device is an electron-emitting device according to claim 12.

14. An image-forming apparatus comprising an electron source according to claim 13, and a light emitting member emitting light responsive to an irradiation with an electron emitted from said electron source.

* * * * *

UNITED STATES PATENT AND TRADEMARK OFFICE

CERTIFICATE OF CORRECTION

PATENT NO. : 6,642,649 B1
DATED : November 4, 2003
INVENTOR(S) : Keisuke Yamamoto et al.

It is certified that error appears in the above-identified patent and that said Letters Patent is hereby corrected as shown below:

Title page,
Item [56], References Cited, OTHER PUBLICATIONS,
"Vacuum, Society" should read -- Vacuum Society --.
FOREIGN PATENT DOCUMENTS,
"JP 07-235255 9/1995" (second occurrence) should be deleted.

Column 1,
Line 27, "[G. Ditmmer," should read -- [G. Dittmer,--; and
Line 52, "a" should read -- an --.

Column 2,
Line 43, "width" should read -- width than --.

Column 3,
Line 20, "and arranged" should be deleted.

Column 5,
Line 16, "efficient" should be -- efficiency --.

Column 7,
Line 45, "substrate 72" should read -- substrate, 72 --.

UNITED STATES PATENT AND TRADEMARK OFFICE

CERTIFICATE OF CORRECTION

PATENT NO. :6,642,649 B1
DATED : November 4, 2003
INVENTOR(S) : Keisuke Yamamoto et al.

It is certified that error appears in the above-identified patent and that said Letters Patent is hereby corrected as shown below:

Column 8,
Line 15, “be served both” should read -- serve --.

Column 10,
Line 17, “on” should read -- one --.

Signed and Sealed this

Twenty-fifth Day of May, 2004

JON W. DUDAS
*Acting Director of the United States Patent and Trademark Office*